US006892414B2

(12) United States Patent
Wilmo

(10) Patent No.: US 6,892,414 B2
(45) Date of Patent: May 17, 2005

(54) STREET SWEEPER DRAG SHOE

(75) Inventor: Michael S. Wilmo, Crystal, MN (US)

(73) Assignee: Tennant Company, Minneapolis, MN (US)

( * ) Notice: Subject to any disclaimer, the term of this patent is extended or adjusted under 35 U.S.C. 154(b) by 434 days.

(21) Appl. No.: 10/236,096

(22) Filed: Sep. 6, 2002

(65) Prior Publication Data

US 2004/0045109 A1 Mar. 11, 2004

(51) Int. Cl.[7] ..... E01H 1/05
(52) U.S. Cl. ..... 15/82; 15/83; 15/246
(58) Field of Search ..... 15/78, 82–86, 15/246

(56) References Cited

U.S. PATENT DOCUMENTS

| | | | | | |
|---|---|---|---|---|---|
| 2,917,761 | A | * | 12/1959 | Burgdorff | 15/84 |
| 3,008,542 | A | | 10/1961 | Steele | 55/287 |
| 3,588,937 | A | * | 6/1971 | Scruggs et al. | 15/84 |
| 3,604,051 | A | | 9/1971 | Wendel et al. | 15/340.4 |
| 3,639,940 | A | | 2/1972 | Carlson et al. | 15/352 |
| 3,756,416 | A | | 9/1973 | Wood | 210/408 |
| 3,792,569 | A | | 2/1974 | Carlson et al. | 55/288 |
| 3,881,215 | A | | 5/1975 | Krier et al. | 15/340.1 |
| 3,926,596 | A | | 12/1975 | Coleman | 55/304 |
| 3,997,934 | A | * | 12/1976 | Toews | 15/246 |
| 4,017,281 | A | | 4/1977 | Johnstone | 55/334 |
| 4,450,601 | A | * | 5/1984 | Shwayder | 15/246 |
| 4,489,458 | A | * | 12/1984 | Schwayder | 15/246 |
| 4,578,840 | A | | 4/1986 | Pausch | 15/352 |
| 4,660,248 | A | | 4/1987 | Young | 15/340.1 |
| 4,754,521 | A | | 7/1988 | Zoni | 15/340.1 |
| 4,759,781 | A | | 7/1988 | Olson | 96/427 |
| 4,872,233 | A | * | 10/1989 | Brown | 15/83 |
| 4,951,342 | A | * | 8/1990 | Wilson | 15/246 |
| 5,006,136 | A | | 4/1991 | Wetter | 55/290 |
| 5,940,919 | A | * | 8/1999 | Vanderlinden | 15/84 |
| 6,041,464 | A | * | 3/2000 | Ebersole | 15/83 |
| 6,192,542 | B1 | | 2/2001 | Frederick et al. | 15/84 |
| 6,195,836 | B1 | | 3/2001 | Vanderlinden | 15/340.3 |
| 6,195,837 | B1 | | 3/2001 | Vanderlinden | 15/348 |

FOREIGN PATENT DOCUMENTS

| | | |
|---|---|---|
| DE | 1256241 | 12/1967 |
| DE | 1256242 | 12/1967 |
| EP | 0453177 | 4/1991 |
| WO | 03/069071 | 2/2003 |

* cited by examiner

*Primary Examiner*—Mark Spisich
(74) *Attorney, Agent, or Firm*—Altera Law Group, LLC

(57) ABSTRACT

A street sweeper drag shoe of cast austempered ductile iron used with a rotary broom in sweeping, whereby escaping debris from under a contact skid is recaptured. The street sweeper drag shoe contains a deflection plate that redirects bristle tip movement inwardly to allow the broom to recapture debris which escapes during normal operation. The street sweeper drag shoe also includes an angled wedge for concentrating outer bristles of the broom into a rotating barrier to prevent debris migration to the ends of the broom. The contact skid exhibits total planar contact with the roadway without interceding carbide wear plates.

14 Claims, 12 Drawing Sheets

STREET SWEEPER DRAG SHOE

CROSS REFERENCES TO RELATED APPLICATIONS

None.

BACKGROUND OF THE INVENTION

1. Field of the Invention

The present invention is for a street sweeper drag shoe used in a sweeping operation, and more particularly, pertains to a street sweeper drag shoe of cast austempered ductile iron with a deflection plate and a skirted contact skid utilized for accomplishing substantially complete dirt and debris collection by a street sweeper.

2. Description of the Prior Art

Prior art street sweeper drag shoes have uniformly been designed as a shaped linear piece of metal. A street sweeper drag shoe performs a critical containment function in street sweeping machines. A rotary broom is mounted on a supporting axle and the bottom regions of the rotary broom align in close proximity to the inner surfaces of opposing sweeper drag shoes. Sweeper drag shoes define the boundary of the sweeping area, and can serve to mount skirted panels surrounding the lower edges of the rotary broom and sealingly contact the road surface as the mobile street sweeper accomplishes its sweep. One drawback of this configuration is that a wedge of dirt and debris rapidly builds up in front of the rotary broom during its sweeping action, and this wedge, like a wedge of water, builds and drifts to the ends of the rotary broom. The typical sweeper drag shoe is intended to form a seal on either end of the lower edges of the rotary sweeper broom to contain the dirt wedge. The current art sweeper drag shoe design allows dirt and debris to escape beneath the sweeper drag shoe, particularly on uneven surfaces, resulting in an incomplete collection of dirt and debris at the edges of the sweeping path.

Prior art drag shoes often required time-consuming fabrication and assembling, adding to the cost and effort required to produce a suitable sweeper drag shoe. Yet another drawback of prior art sweeper drag shoes is the use of carbide wear plates, which are intended to prolong the wear and use of the sweeper drag shoes. The use of carbide wear plates, while being partly successful in prolonging drag shoe life, often caused either cosmetic or structural damage to the roadway surface, as the weight of the drag shoes and other attendant structures is concentrated at the points of contact between the roadway and the carbide wear plates. The carbide wear plates would often outlast the contact skid of the drag shoe which was being protected in the area whereat the contact skid of the drag shoe would be subjected to abrasion by sand, rocks, stones and the like which would abrasively impinge the contact skid of the drag shoe during sweeping operations. However, sealing of or near the lower surface of the drag shoe with the use of carbide wear plates carried the lower surface of the drag shoe, i.e., the contact skid, just slightly above the roadway surface, leaving the carbide wear plates, which exhibit less contact than the contact skid of the drag shoe, as the actual sealing barrier instead of the contact skid of the drag shoe. Carbide wear plates, some of which are replaceable, can encounter road anomalies which can strain the connecting hardware and cause the carbide wear plates to be sheared from the underside of the contact skid.

What is needed is simply a fabricated sweeper drag shoe that has an improved contact skid to maximize roadway contact; that has an improved rotary broom seal along the forward portion of the sweeper drag shoe; that redirects the broom bristles so as to collect and redirect the escaping wedge of dirt and debris which exits from beneath the sweeper drag shoe; that is extremely durable and that otherwise overcomes the shortcomings of previous sweeper drag shoes.

The present invention provides a street sweeper drag shoe of cast austempered ductile iron having an improved forward portion seal and an improved drag shoe to surface seal, and which provides means to contain and redirect the escaping wedge portion of dirt and debris.

SUMMARY OF THE INVENTION

The general purpose of the present invention is to provide for a more complete means of collecting dirt and debris in the process of road sweeping by providing an improved and one-piece street sweeper drag shoe. The street sweeper drag shoe which is cast can be provided as a right-hand version, as shown herein, or as a left-hand version having a mirror image likeness where each is utilized on opposing ends of a rotary broom in a sweeping truck.

The street sweeper drag shoe includes portions described herein and referred to and related to herein as separate components for purposes of example and illustration, but in actuality the street sweeper drag shoe is a one-piece structure utilizing a plurality of geometrically shaped portions or structures, some of which intersect, including a longitudinally extending and horizontally oriented planar contact skid, a longitudinally extending and vertically oriented planar attachment bar extending substantially at a right angle vertically from the planar contact skid, an angled wedge extending along a major portion of the inner and lower side of the planar attachment bar, a vertically oriented deflection plate at an angle with respect to and at the rear region of the longitudinal axis of the planar attachment bar, and an angled plate extending between the planar contact skid and the planar attachment bar at the forward region or nose of the street sweeper drag shoe. An enhanced (forward) seal at the central portion of the street sweeper drag shoe is provided in the region of and forward of tangential and near tangential brush contact with the angled wedge extending partially along the inner and lower side of the planar attachment bar, whereby the rotating broom outer bristles are forced together to provide a thicker bristle population which acts as a unified rotating barrier. At the rear region of the street sweeper drag shoe redirection and recapture of unwanted dirt and debris exiting from the area below the street sweeper drag shoe is accomplished by alteration and influencing of the behavior of the rotating broom outer bristles.

In accordance with the present invention, the combination of the attachment bar and plate form a broom bristle compression member having a tapered end section, the structure of which may be implemented by a wide array of structural details all of which are intended to be within the true spirit and scope of the present invention. Most specifically, the description of the invention has been depicted employing right angle members for illustrative purposes. However, the members need only be transverse to the road surface in order to compress the broom bristles in a manner as described in the figures.

Similarly, the wedge or skirt as depicted in the drawings may have other contours beyond that illustrated herein. For example, lowest most portion of the combination of the attachment bar and skid need only be contoured so to provide the most compression of the broom bristles toward the central axis of the broom as compared to other portions away from the road surface.

It should be recognized by those skilled in the art that the structure as depicted in the drawings may be implemented by a wide array of structural details and assemblies. Although the structure has been illustrated by way of generally planar stock materials, it may be constructed of tubular materials as well. Although the skid has been illustrated as one elongated piece of stock material, it may be constructed by way of a forward end piece having a slanted formed end member and a rearward end, both of which are assembled together by way of the transverse bar member. The wedge or skirt, although illustrated as a separate member, may, of course, be formed into the attachment bar or the skid itself, depending, of course, upon the chosen assembly techniques.

During normal prior art sweeping operations, the outer bristles are splayed outwardly in an outward and transverse direction to a magnitude approximately equalling the width of the street sweeper drag shoe and the dirt and debris escaping from the bottom thereof. Incorporation of the present invention requires the street sweeper drag shoes to be offset toward the center of the sweep path slightly. Such offsetting brings the outwardly splayed ends of the outer bristles into contact with the deflection plate at the rearward region of the street sweeper drag shoe. Such contact of the rotating outwardly splayed bristle ends with the angled deflection plate redirects and urges the rotating outer bristle ends or tips inwardly toward the center of the sweep path, thereby sweeping and carrying the dirt and debris once again into the wedge and into the more centrally located region of the sweeping path of the rotary broom.

According to one embodiment of the present invention, there is a cast sweeper drag shoe of austempered ductile iron including a longitudinally extending and horizontally oriented planar contact skid, a longitudinally extending and vertically oriented planar attachment bar extending substantially at a right angle vertically from the planar contact skid, an angled wedge extending along a major portion of the inner and lower side of the planar attachment bar, a vertically oriented deflection plate at an angle with respect to and at the rear region of the longitudinal axis of the planar attachment bar, and an angled plate extending between the planar contact skid and the planar attachment bar at the forward region or nose of the street sweeper drag shoe.

One significant aspect and feature of the present invention is a street sweeper drag shoe which is one-piece and which is cast.

Another significant aspect and feature of the present invention is a street sweeper drag shoe utilizing cast austempered ductile iron to achieve durability and long life.

Another significant aspect and feature of the present invention is a street sweeper drag shoe which exhibits planar contact with the street surface.

A further significant aspect and feature of the present invention is the ability to recapture dirt and debris which exits from beneath a street sweeper drag shoe.

Another significant aspect and feature of the present invention is a deflection plate located at the rear of the street sweeper drag shoe.

Yet another significant aspect and feature of the present invention is a deflection plate which redirects rotating broom bristles inwardly and transversely to sweep dirt and debris inwardly and transversely.

Still another significant aspect and feature of the present invention is an angled wedge extending along a major portion of the lower and inner side of the planar attachment bar for improved sealing to prevent migration of dirt and debris during straight-ahead sweeping or sweeping in a turn.

Having thus described an embodiment of the present invention and enumerated significant aspects and features thereof, it is the principal object of the present invention to provide a street sweeper drag shoe which is cast austempered ductile iron and which functions to attain substantially complete debris collection in a road sweeping operation.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENT

Figure 1A:
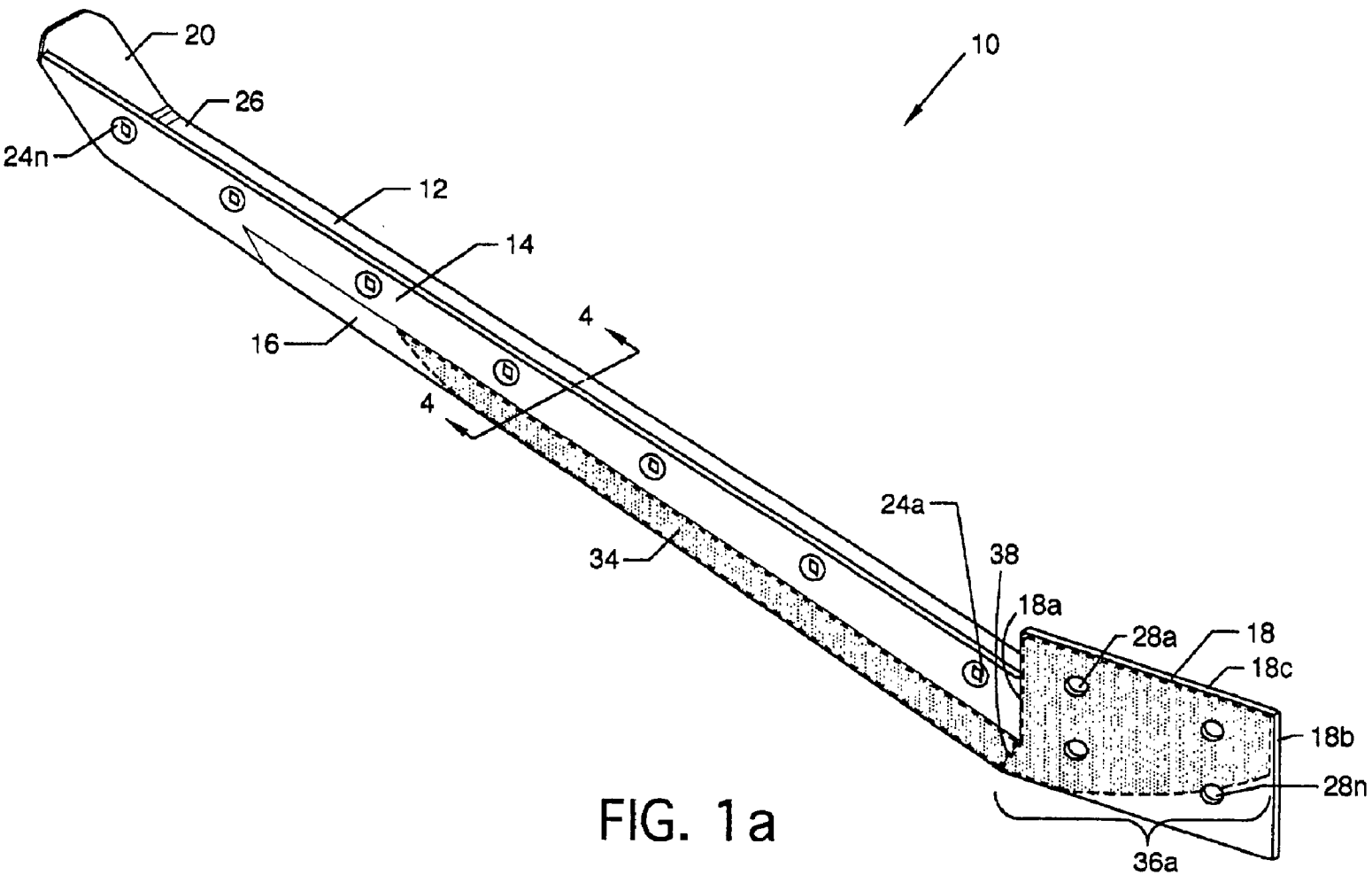
FIG. 1*a* illustrates an isometric view of one side of a street sweeper drag shoe.
Figure 2A:
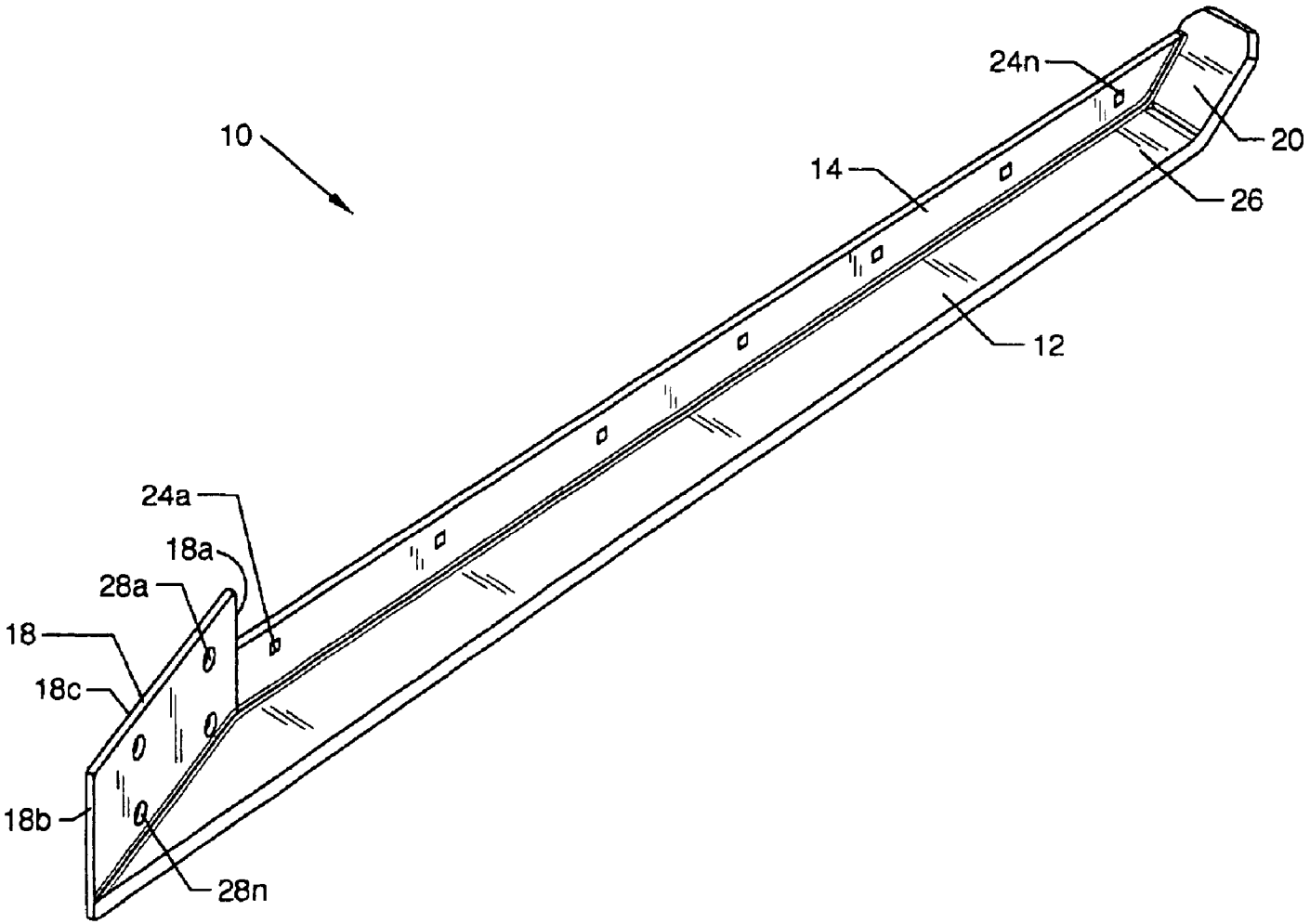
FIG. 2*a* illustrates an isometric view of the opposing side of the street sweeper drag shoe.

FIG. 1*a* illustrates an isometric view of one side, and FIG. 2*a* illustrates an isometric view of the opposing side of a one-piece street sweeper drag shoe 10, the present invention, being of long lasting and durable cast austempered ductile iron. The austempered ductile iron castings for the street sweeper drag shoe 10 are produced by combining carefully controlled processes to properly alloy a base metal to a required standard such as specified per ASTM A897-90 to produce a grade 230-185—austempered ductile iron casting having a tensile strength of 230,000, a yield of 185,000, a negligible elongation factor and a Brinell scale of 444–555 being exceptionally high in hardness, yield strength and tensile strength. The major structural features of the one-piece street sweeper drag shoe 10 of the present invention include a contact skid 12, an attachment bar 14, an angled wedge 16 (FIG. 1*a*) a deflection plate 18, and an angled plate 20. The structure of the street sweeper drag shoe 10 centers along and about the longitudinally extending and horizontally oriented planar contact skid 12. The longitudinally extending and vertically oriented planar attachment bar 14, including mounting holes 24*a*–24*n*, extends substantially at a right angle vertically from the planar contact skid 12 and longitudinally from a forward end 26 of the contact skid 12 to the vertically aligned deflection plate 18. The vertically aligned deflection plate 18 aligns at a suitable angle to the rear portion of the attachment bar 14 and aligns to and extends upwardly from the rear portion of contact skid 12. The attachment bar 14 serves as an attachment point for flexible support arms or structures, skirts, panels and the like. The angled wedge 16 (FIG. 1*a*) extends along a major portion of the inner and lower side of the planar attachment bar 14. The vertically oriented deflection plate 18, including mounting holes 28*a*–28*n*, aligns at an angle with respect to the longitudinal axis of the planar attachment bar 14 and at an angle with respect to the longitudinal axis of the contact skid 12 at the rear of the contact skid 12. The angled plate 20 extends between the contact skid 12 and the attachment bar 14 at the forward end 26 or nose of the street sweeper drag shoe 10.

Figure 1B:
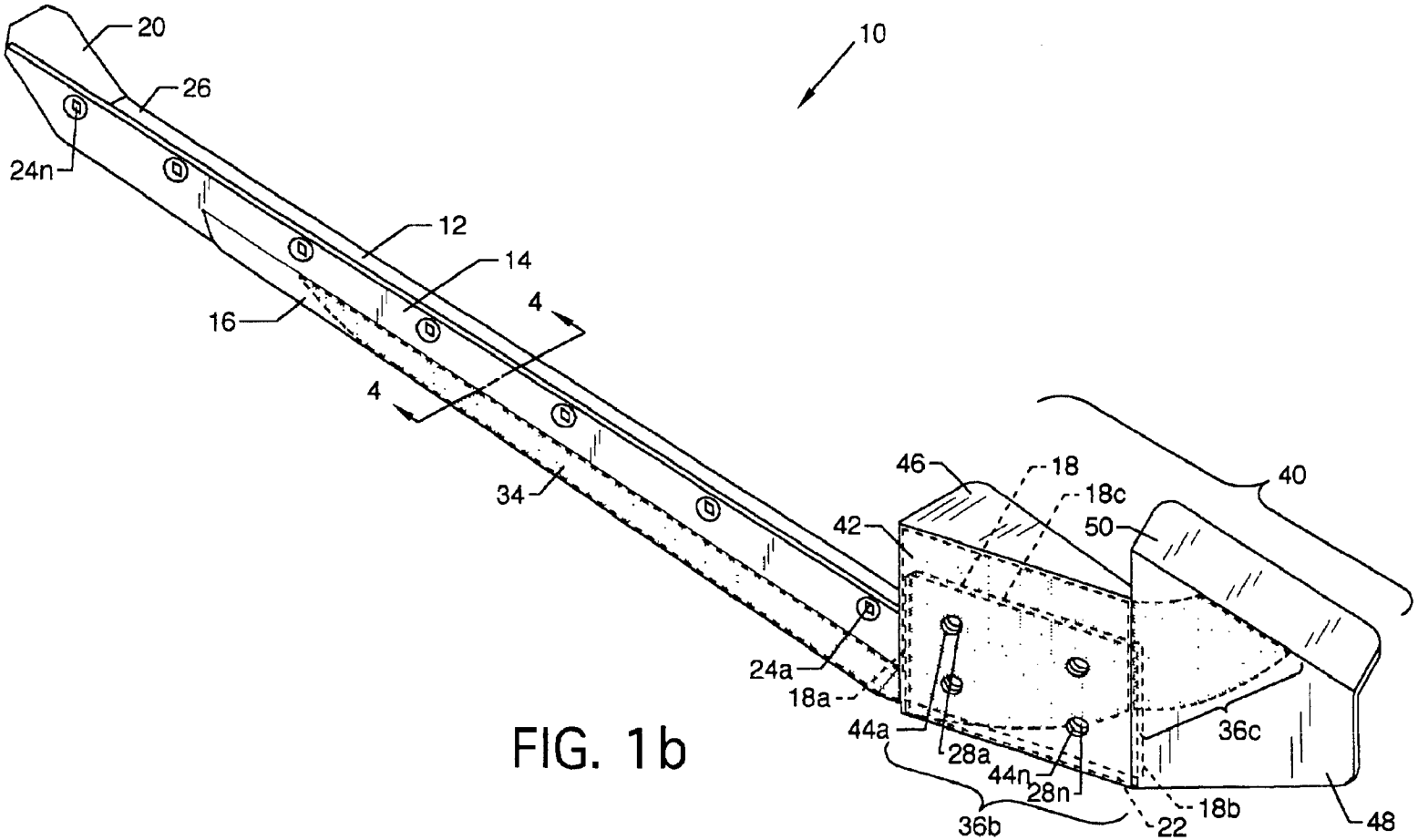
FIG. 1*b* illustrates an isometric view of one side of a street sweeper drag shoe including an optional deflection plate extender.

FIG. 1*b* illustrates the sweeper drag shoe 10 of FIG. 1*a* including an optional deflection plate extender 40 secured over and about the deflection plate 18 to lend additional guidance of rotary broom bristles as later described in detail. The deflection plate extender 40 includes several plates having an angular relationship to other plates of the deflection plate extender 40. Each individual plate of the deflection plate extender 40 can be bent or angled to extend at an angle from the main portion of the plate. The deflection plate extender 40 can be one-piece or can be an assembly of plates joined such as by welding. For purposes of illustration and example the deflection plate extender 40 is described as individual plates although the plates may be connected or may have portions extending therefrom. A vertically aligned deflection plate 42, including a plurality of mounting holes 44*a*–44*n*, having a greater vertical dimension than the deflection plate 18 and extending upwardly beyond the top edge 18*c* of the deflection plate 18 secures to and over the deflection plate 18 using suitable hardware which is accommodated by the mounting holes 44*a*–44*n* of the deflection plate 42 and mounting holes 28*a*–28*n* of the deflection plate 18. The deflection plate 42 has the same angular relationship with respect to the longitudinal axis of the planar attachment bar 14 and of the contact skid 12 in alignment with the tapered region 22 at the rear of the contact skid 12 that is exhibited by the deflection plate 18. A horizontally oriented plate 46 extends preferably at a right angle or any desirable angle outwardly from the upper region of the deflection plate 42. Another vertically oriented and geometrically configured containment plate 48 extends rearwardly and at an angle from the deflection plate 42 the planar region of which is parallel to the vertically aligned planar region of the attachment bar 14. An angled plate 50 extends upwardly and preferably at an angle from the upper region of the containment plate 48.

Figure 2B:
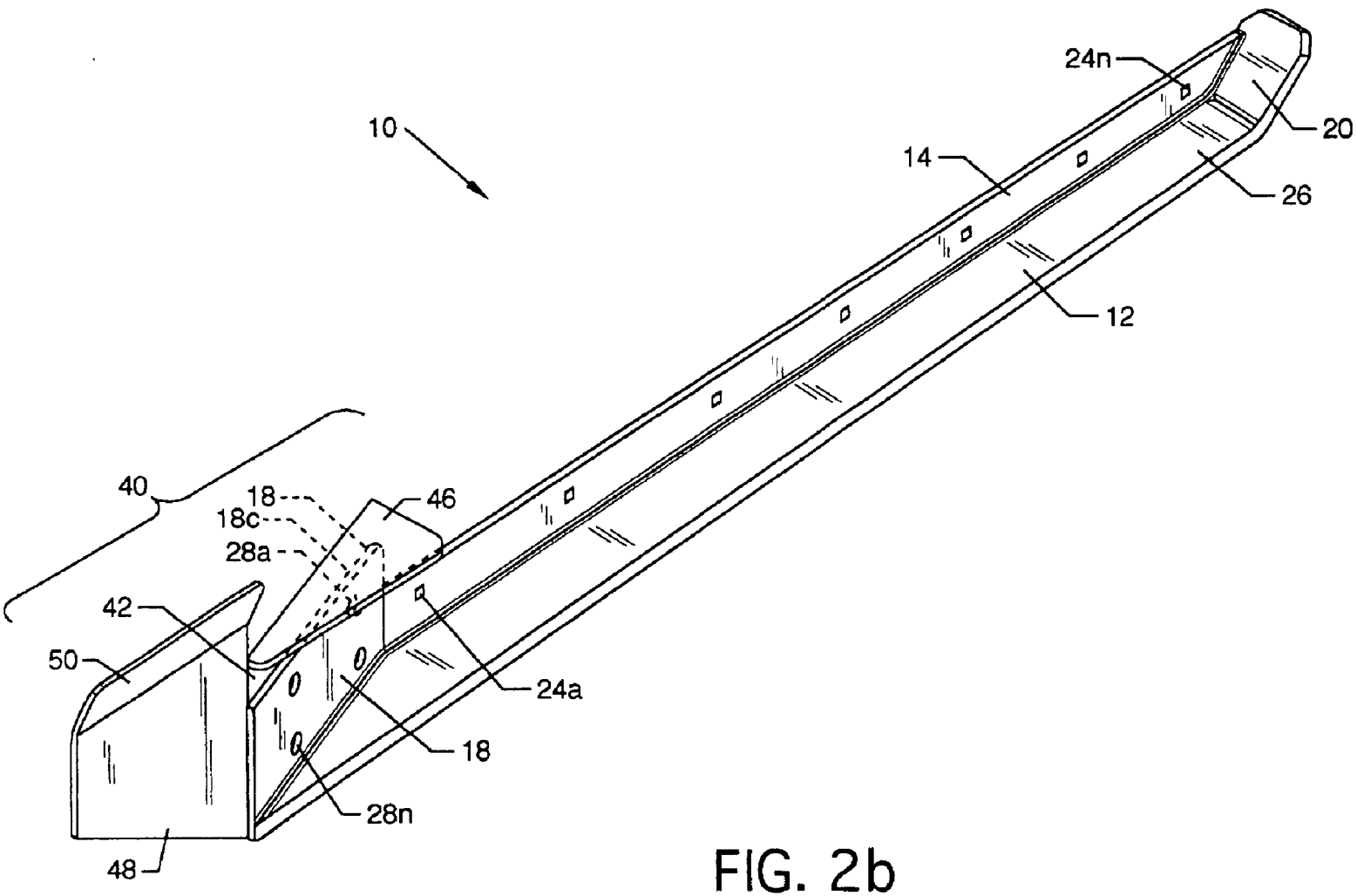
FIG. 2*b* illustrates an isometric view of the opposing side of the street sweeper drag shoe including an optional deflection plate extender.

FIG. 2*b* illustrates the sweeper drag shoe 10 of FIG. 2*a* including the optional deflection plate extender 40 secured over and about the deflection plate 18 to lend additional guidance of the rotary broom bristles as later described in detail.

Figure 3A:
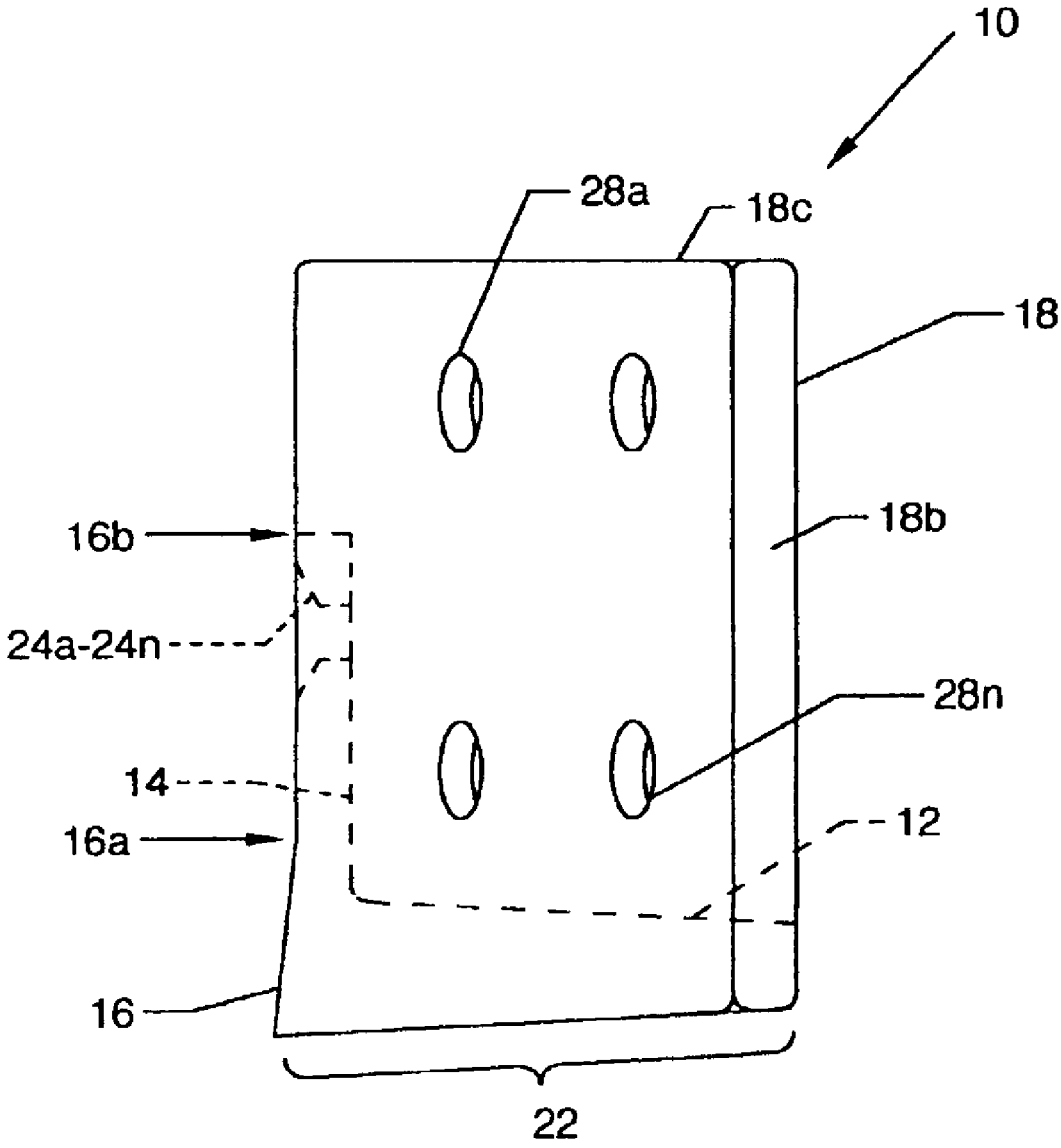
FIG. 3*a* is a rear view illustrating the general configuration of the deflection plate and the angled wedge of the street sweeper drag shoe.

FIG. 3*a* illustrates a rear view of the street sweeper drag shoe 10. Illustrated in particular is the general configuration of the deflection plate 18 and the angled wedge 16 which extends outwardly from and longitudinally along the major portion of the inner and lower side of the planar attachment bar 14. Although the upper termination region of the angled wedge 16 is shown terminating at location 16*a* on the attachment bar 14, the upper termination region of the angled wedge 16 could terminate anywhere up to location 16*b* on the attachment bar 14 or it could terminate somewhere below location 16*a* on the attachment bar 14, as desired.

Figure 3B:
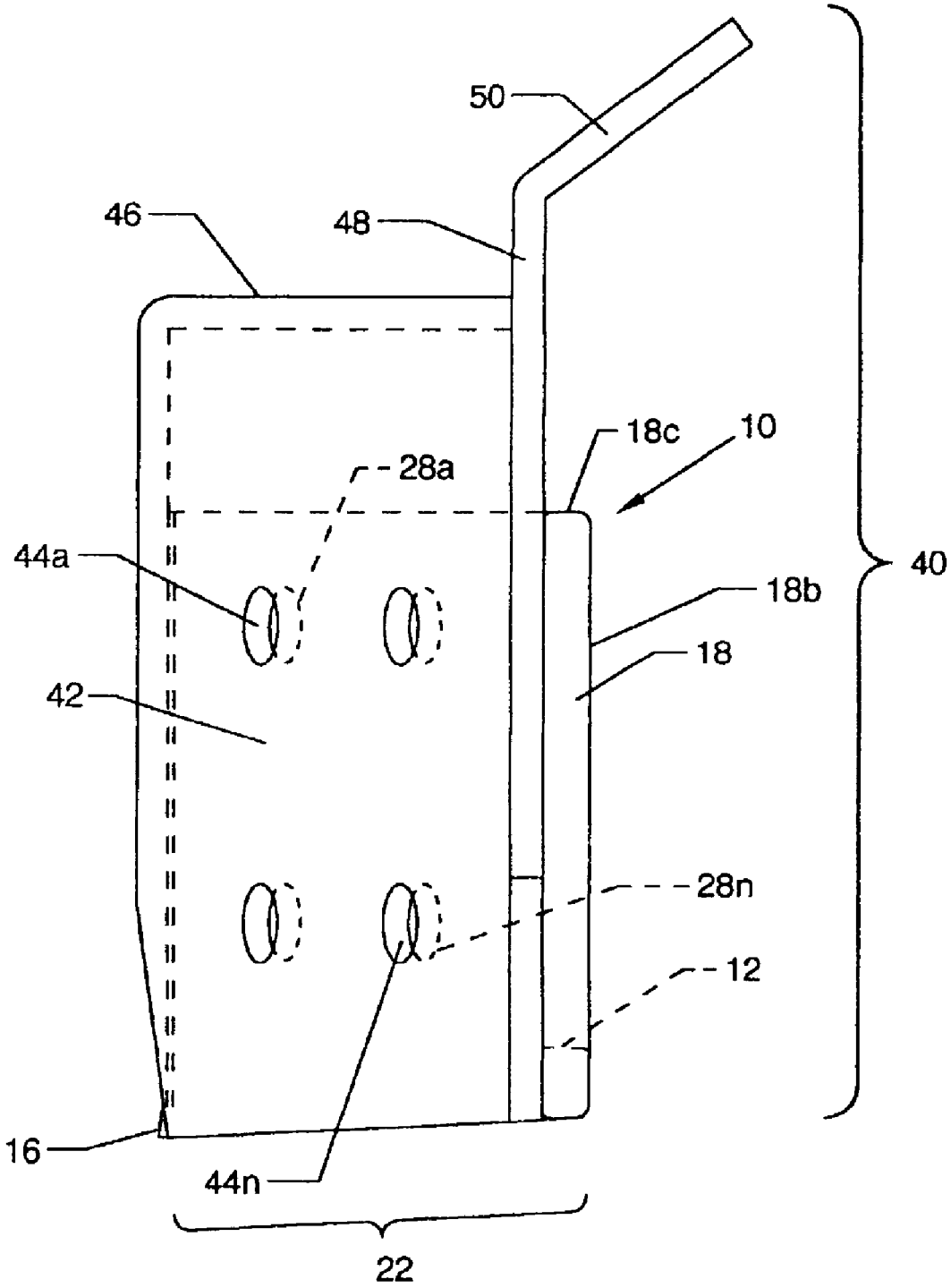
FIG. 3*b* is a rear view illustrating the general configuration of the deflection plate and the angled wedge of the street sweeper drag shoe including an optional deflection plate extender.

FIG. 3*b* illustrates the sweeper drag shoe 10 of FIG. 3*a* including the optional deflection plate extender 40 secured over and about the deflection plate 18 to lend additional guidance of the rotary broom bristles as later described in detail.

Figure 4:
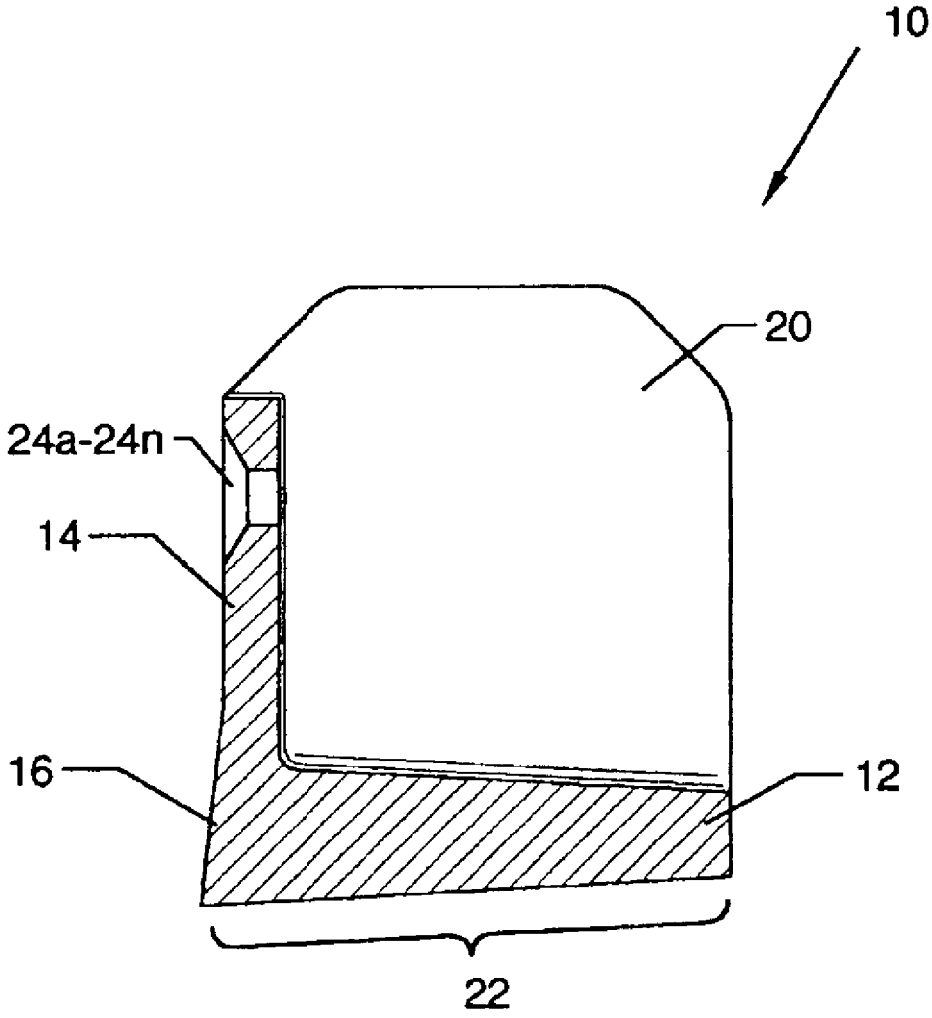
FIG. 4 illustrates a cross section view of the street sweeper drag shoe along line 4—4 of FIG. 1.

FIG. 4 is a cross section view of the street sweeper drag shoe 10 along line 4—4 of FIG. 1*a* showing the contact skid 12 as well as casting draft along and about the contact skid 12, the attachment bar 14, and the angled wedge 16 as a single, unitary, one-piece cast metal body having the overall cross section indicated in the figure. Especially shown is the planar nature of the contact skid planar surface 22 unencumbered by any other contact surface such as carbide plates or runners.

Mode of Operation

The street sweeper drag shoes 10, the present invention, function as seals on the ends of rotary brooms or brushes during street sweeping operations. The present invention allows for more complete sweeping by creating an improved seal along a forward region of rotary broom contact with the angled wedge 16 and at a rearward region, by redirecting wedged debris that manages to escape beneath the contact skid 12 which is influenced by outer broom bristles which are redirected by the deflection plate 18 as the road sweeper encounters uneven road surfaces, and by total planar contact of the contact skid 12 with the roadway surface. Previous sweeper drag shoes have allowed wedged debris to escape under and around the sweeper drag shoe during normal operation. The present invention allows the broom to capture the spilled or escaped wedged debris as the debris passes below the footprint of the street sweeper drag shoe 10. The deflection plate 18 of the street sweeper drag shoe 10 provides a suitable surface against which outer bristles of a rotary broom can impingingly contact in order to produce inwardly directed sweeping action that will collect and redirect the debris escaping from beneath the street sweeper drag shoe 10.

The mode of operation is now shown and described with reference to FIGS. 5*a*, 5*b*, 6*a*, 6*b* and 7.

Figure 5A:
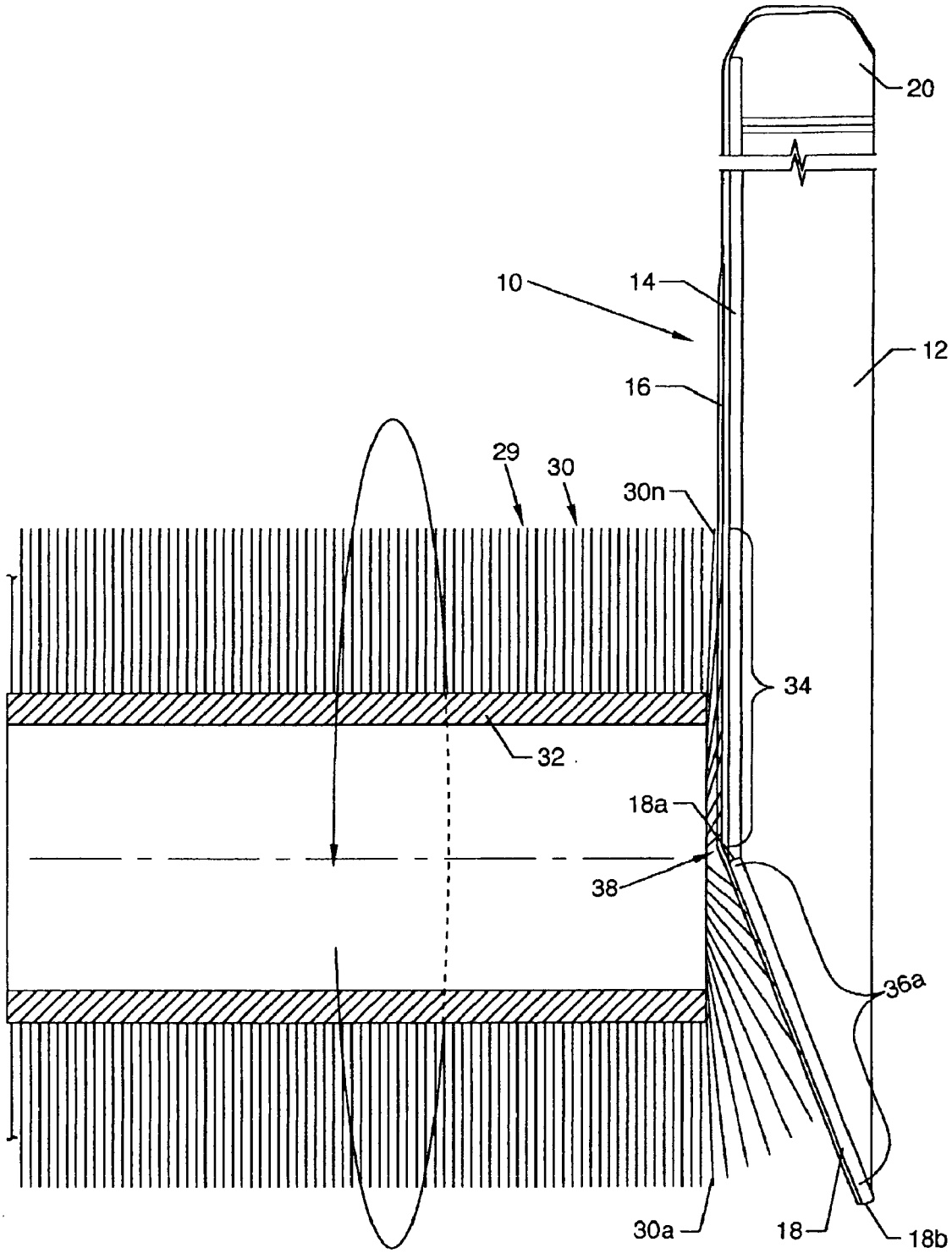
FIG. 5*a* illustrates a top view of the street sweeper drag shoe mounted relative to a rotary broom, shown in cross section, and further illustrates the rotary broom rotationally contacting the street sweeper drag shoe angled wedge and deflection plate during the sweeping operation.

FIG. 5*a* illustrates a top view of the street sweeper drag shoe 10 in active use with a rotary broom 29, shown in cross section, which includes a plurality of sets of bristles 30 arranged in rows extending outwardly in radial fashion from a central rotary broom hub 32. Attention is directed to a plurality of outer bristles 30*a*–30*n* which are located at the end of the rotary broom hub 32. Contact of the ends of the outer bristles 30*a*–30*n* with the street sweeper drag shoe 10 is significant and beneficial to thorough and complete sweeping in a rearward contact region 36*a* and in a forward contact region 34, the regions of which are best shown in FIG. 1*a*. The forward contact region 34 extends as a region having one side being arced in correspondence to the tip movement and impingement path of the outer bristles 30*a*–30*n* along a portion of the angled wedge 16 from the intersection 38 of the angled wedge 16 and the deflection plate 18, as also viewed in FIG. 1*a*. The rearward contact region 36*a* extends as a region having one side being arced in correspondence to the tip movement and impingement path of the outer bristles 30*a*–30*n* along a major portion of the deflection plate 18 extending from a portion of the trailing edge 18*b* of the deflection plate 18 to the leading edge 18*a* of the deflection plate 18 and to the rearward extent of the angled wedge 16 (intersection 38), as also viewed in FIG. 1*a*. As the rotary broom 29 is rotated, the tips of the bristles 30 are brought into forced contact with the road surface resulting in bristle loading resulting in sideways directed displacement or outward splaying of the uncontained outer bristles 30*a*–30*n* in a direction away from the bristles 30 inboard of the outer bristles 30*a*–30*n*. Constant and repeated sideways displacement of the outer bristles 30*a*–30*n* causes the outer bristles 30*a*–30*n* to maintain an outwardly directed set whereby the outer bristles 30*a*–30*n* are angled outwardly from the rotary broom hub 32. During rotation of the rotary broom 29, the outer bristles 30*a*–30*n* are influenced and redirected by the invention to prevent debris and dirt from gathering beneath the street sweeper drag shoe 10 and/or to sweep debris and dirt which may inadvertently find its way under the street sweeper drag shoe 10 back into the main sweeping path. Accordingly, the street sweeper drag shoes 10 are suitably aligned with the outer bristles 30*a*–30*n* of the rotary broom 29.

Figure 5B:
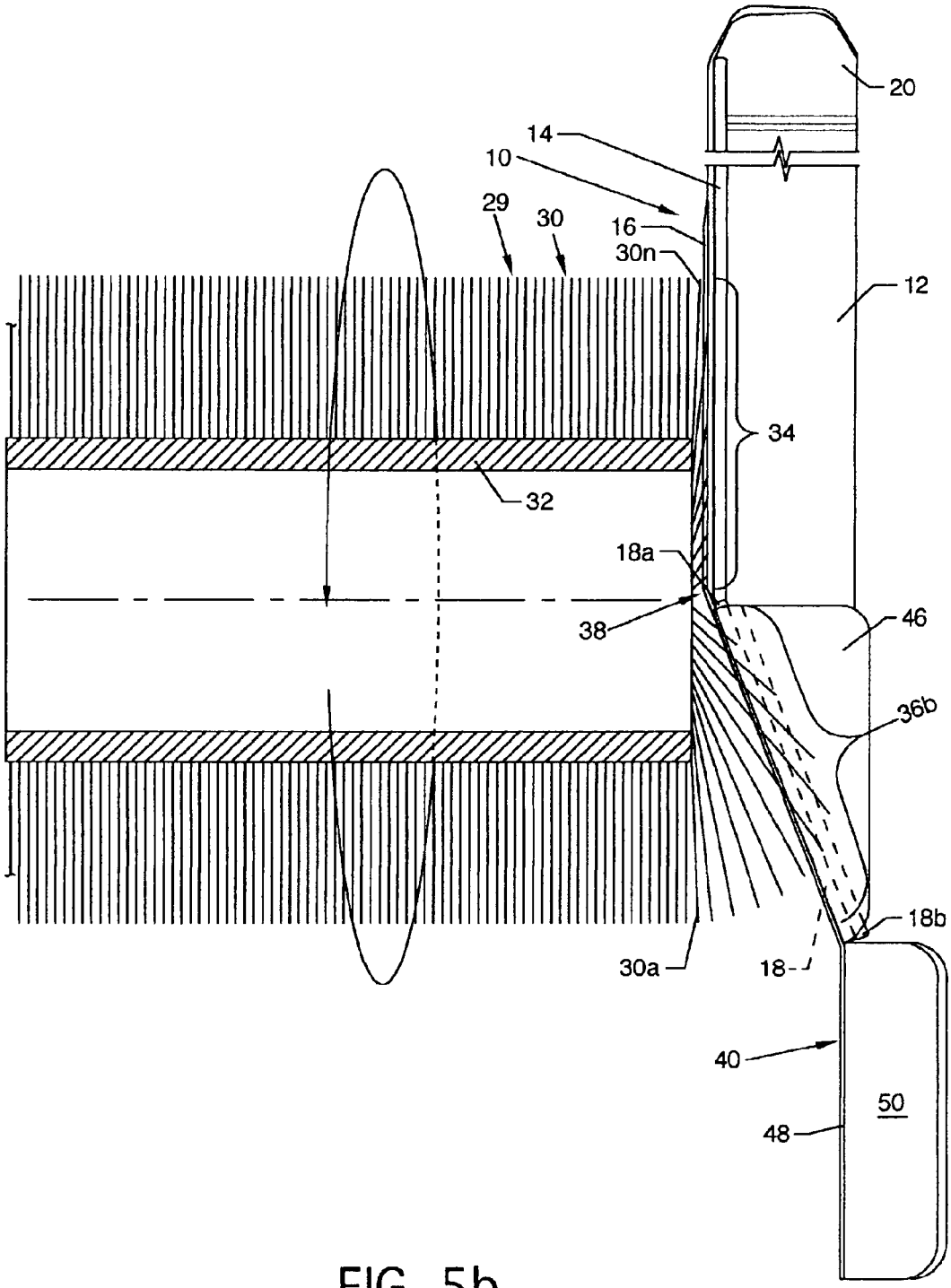
FIG. 5*b* illustrates a top view of the street sweeper drag shoe, including an optional deflection plate extender, mounted relative to a rotary broom, shown in cross section, and further illustrates the rotary broom rotationally contacting the street sweeper drag shoe angled wedge and deflection plate during the sweeping operation.

FIG. 5*b* illustrates a top view of the sweeper drag shoe 10 of FIG. 5*a* in active use with a rotary broom 29 where the optional deflection plate extender 40 is attached to the sweeper drag shoe 10 to provide for additional upper level guidance of the outer bristles, such as bristles 30*a*–30*n*, which may be excessively splayed outwardly in a direction away from the bristles 30 inboard of the outer bristles 30*a*–30*n*. The optional deflection plate extender 40 is useful where the bristles 30*a*–30*n* are of a length where the bristles require extra guidance or where the bristles 30*a*–30*n* could incur damage if impingement with the upper edge 18*c* of the deflection plate 18 could occur if the optional deflection plate extender 40 were not used. Plate 46 of the optional deflection plate extender 40 prevents contact of the outer bristles 30*a*–30*n* with the upper edge 18*c* of the deflection plate 18. As shown in FIG. 1*b*, the optional deflection plate extender 40 includes a rearward contact region 36*b* along and about the deflection plate 42, similar in many respects to the rearward contact region 36*a* of the deflection plate 18, but extending upwardly to include the vertically extended portion of the deflection plate 42. Correspondingly, another rearward contact region 36*c* is located along and about the containment plate 48. The containment plate 48 and the angled plate 50 can be incorporated to provide for a seal with panels surrounding the rotary broom 29 (not shown).

Figure 6A:
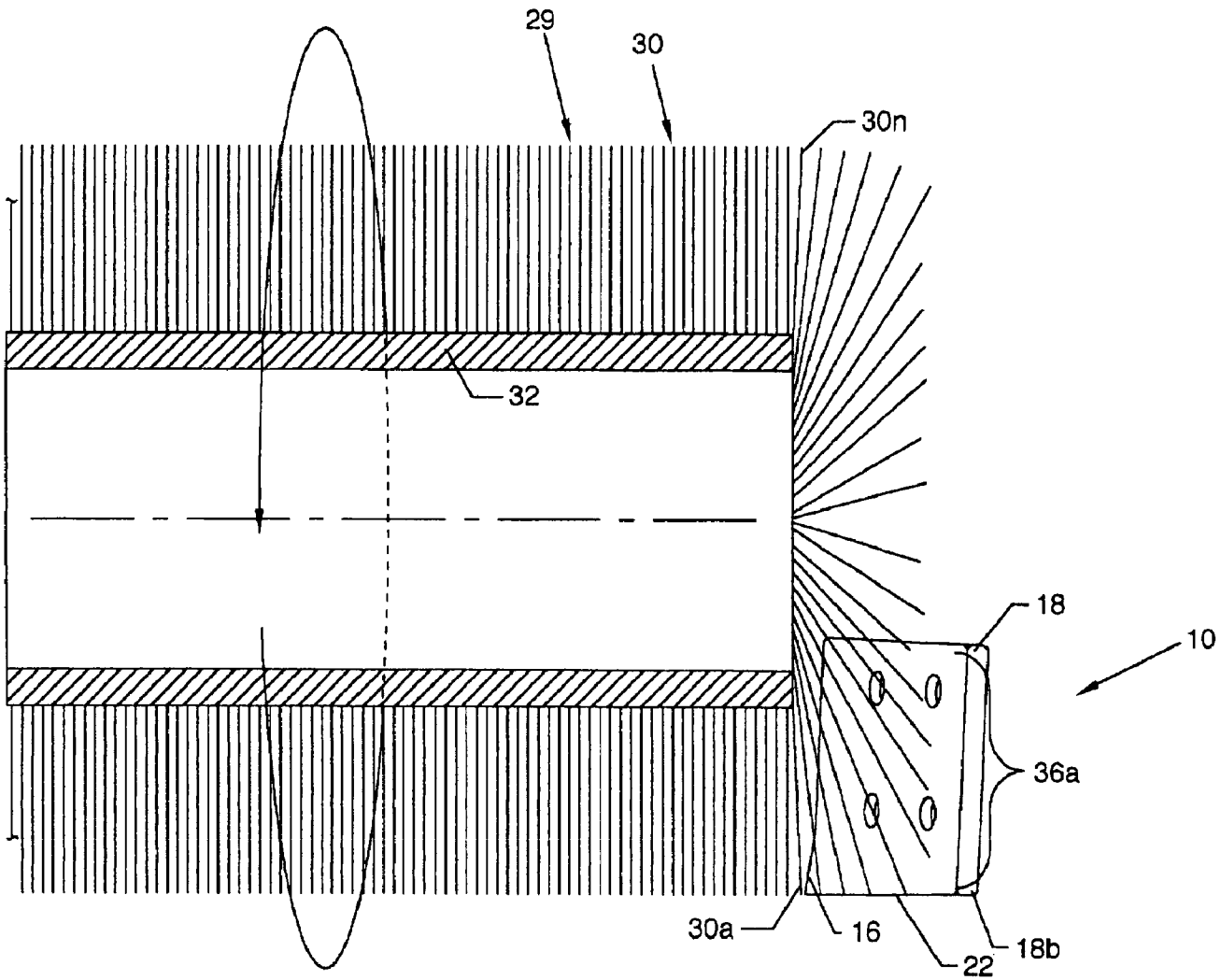
FIG. 6*a* illustrates a rear view of the rotary broom, shown in cross section, and the street sweeper drag shoe, illustrating the interaction of the rotary broom with the rearward contact region of the deflection plate.

FIG. 6*a* illustrates a portion of the outer bristles 30*a*–30*n* in contact with the rearward contact region 36*a* of the deflection plate 18 of the street sweeper drag shoe 10. The street sweeper drag shoe 10 often attaches to a pivotal drag shoe support arm of a street sweeper by means of a semi-rigid but flexible member extending between the pivotal drag shoe support arm and the attachment bar 14 shown in FIG. 1*a*. Such flexible attachment and weight of the street sweeper drag shoe 10 allows and causes the contact skid planar surface 22 to seek, find and achieve planar contact with the roadway when lowered to meet the roadway. During rotation of the rotary broom 29, the outwardly splayed outer bristles 30*a*–30*n* are urged inwardly by rotationally induced contact with the deflection plate 18. Just prior to contacting the deflection plate 18, the tips of the outer bristles 30*a*–30*n* contact the road surface just behind the deflection plate 18 to momentarily urge the dirt and debris in a forward direction followed by inward and forward movement of the tips of the outer bristles 30*a*–30*n* to urge and carry the dirt and debris to a more centrally located position where sweeping away of the dirt and debris can be accomplished by the central bristles 30 which are inboard of the outer bristles 30*a*–30*n*.

Figure 6B:
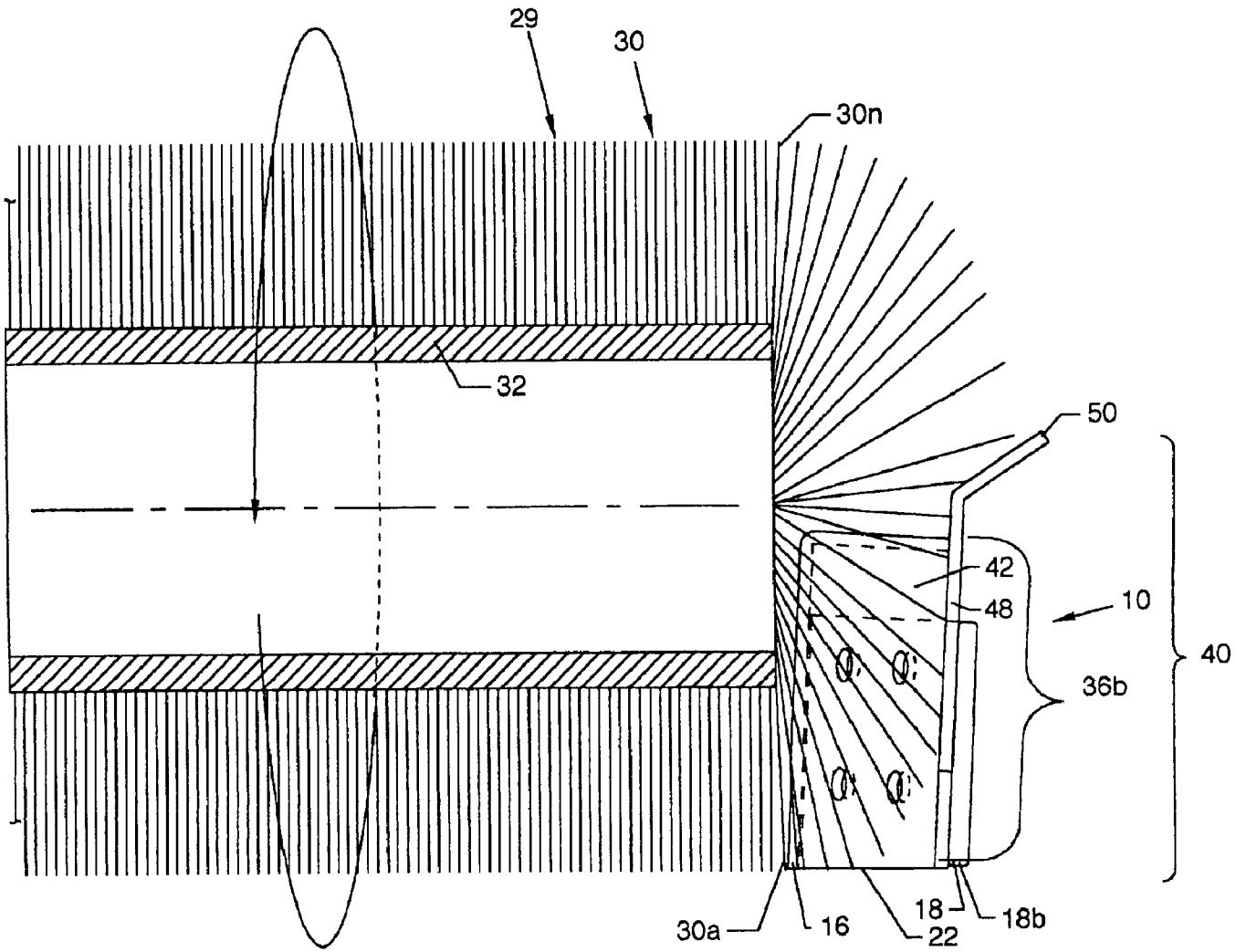
FIG. 6*b* illustrates a rear view of the rotary broom, shown in cross section, and the street sweeper drag shoe, including an optional deflection plate extender, illustrating the interaction of the rotary broom with the rearward contact region of the deflection plate; and, FIG. 7 illustrates a rear view of the rotary broom, shown in cross section, interacting with the forward contact region of the street sweeper drag shoe.

FIG. 6*b*, a rear view, illustrates a portion of the outer bristles 30*a*–30*n* in contact with the rearward contact region 36*b* of the deflection plate 42, as well as the rearward contact region 36*c* of the containment plate (not shown), of the optional deflection plate extender 40 attached to the sweeper drag shoe 10 where additional guidance of the outwardly splayed bristles 30*a*–30*n* is provided.

Figure 7:
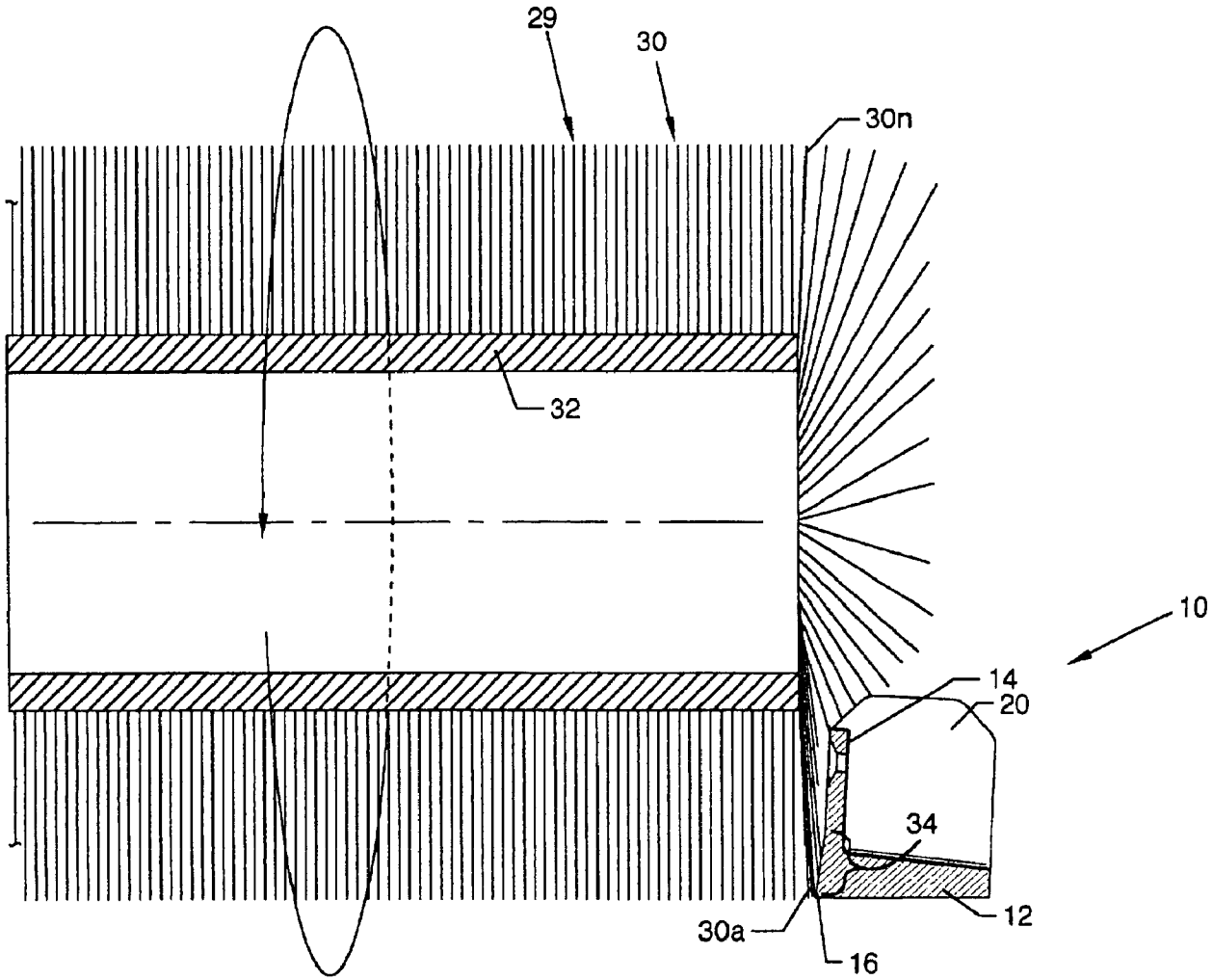

FIG. 7 illustrates a portion of the outer bristles 30*a*–30*n* in contact with the forward contact region 34 of the angled wedge 16 of the street sweeper drag shoe 10. The tips of the outer bristles 30*a*–30*n* are urged inwardly during impingement with the angled wedge 16 to provide a densely concentrated and tightly formed rotating band or barrier of outer bristle tips 30*a*–30*n* to discourage dirt and debris migration at the end of the sweeping wedge and subsequent lodging beneath the contact skid 12.

Various modifications can be made to the present invention without departing from the apparent scope hereof.

STREET SWEEPER DRAG SHOE
PARTS LIST

| | |
|---|---|
| 10 | street sweeper drag shoe |
| 12 | contact skid |
| 14 | attachment bar |
| 16 | angled wedge |
| 16a–b | locations |
| 18 | deflection plate |
| 18a | leading edge |
| 18c | top edge |
| 18b | trailing edge |
| 20 | angled plate |
| 22 | contact skid planar surface |
| 24a–n | mounting holes |
| 26 | forward end |
| 28a–n | mounting holes |
| 29 | rotary broom |
| 30 | bristles |
| 30a–n | outer bristles |
| 32 | rotary broom hub |
| 34 | forward contact region |
| 36a–c | rearward contact regions |
| 38 | intersection |
| 40 | deflection plate extender |

What is claimed is:

1. A street sweeper drag shoe comprising:

a. a contact skid for traveling along a roadway, said contact skid having a planar lower surface for facing the surface of the roadway, an upper surface, a forward end, and a rearward end;

b. an attachment bar joined to said contact skid and forming a right angle with said contact skid, said attachment bar projecting upwardly with respect to said upper surface of said contact skid and having a top edge;

c. an angled wedge extending along said attachment bar and having a planar bottom surface aligned with said planar lower surface of said contact skid and a slanting top surface;

d. a deflection plate carried by said contact skid at said rearward end of said contact skid, said deflection plate meeting said angled wedge at an angle; and, e. an upwardly angled plate at said forward end of said contact skid.

2. The street sweeper drag shoe as defined in claim 1, wherein said contact skid, said attachment bar, said angled wedge, said deflection plate, and said upwardly angled plate are all portions of a single, unitary, one-piece, cast metal body.

3. The street sweeper drag shoe as defined in claim 2, wherein the material of said cast metal body is austempered ductile iron.

4. The street sweeper drag shoe as defined in claim 1, wherein said attachment bar includes mounting holes extending therethrough.

5. The street sweeper drag shoe as defined in claim 1, wherein said deflection plate is rectangular and extends upwardly from said upper surface of said contact skid to a level above said top edge of said attachment bar.

6. A street sweeper drag shoe comprising:

a. an elongated contact skid having an upper surface, a planar lower surface, a forward end, and a rearward end;

b. an elongated attachment bar having a top edge, an inner side, an outer side, a forward end, and a rearward end;

c. said contact skid extending perpendicularly to said attachment bar along the length of said attachment bar and being joined to said attachment bar along the length of said attachment bar from said forward end of said attachment bar to said rearward end of said attachment bar in such a manner that said upper surface of said contact skid together with said outer side of said attachment bar form a right angle inside corner;

d. an angled wedge extending along said inner side of said attachment bar from near said forward end of said attachment bar to said rearward end of said attachment bar, said angled wedge having a planar bottom surface aligned with said planar lower surface of said contact skid and having a surface slanting from said planar bottom surface toward said top edge of said attachment bar and meeting said inner side of said attachment bar;

e. a deflection plate attached to said contact skid at said rearward end of said contact skid, said deflection plate meeting said angled wedge at an angle; and, f. an upwardly angled plate attached to said contact skid and to said attachment bar at said forward ends thereof.

7. The street sweeper drag shoe as defined in claim 6, wherein said contact skid, said attachment bar, said angled wedge, said deflection plate, and said upwardly angled plate are all portions of a single, unitary, one-piece, cast metal body.

8. The street sweeper drag shoe as defined in claim 7, wherein the material of said cast metal body is austempered ductile iron.

9. The street sweeper drag shoe as defined in claim 6, wherein said attachment bar includes mounting holes extending therethrough from said outer side to said inner side above said angled wedge.

10. The street sweeper drag shoe as defined in claim 6, wherein said deflection plate is rectangular and extends upwardly from said contact skid to a level above said top edge of said attachment bar.

11. A street sweeper drag shoe comprising:

a. a right-angle member formed of a horizontally oriented elongated planar member having an upper surface, a planar lower surface, and first and second ends and a vertically oriented elongated planar member having a top edge, an inner side, an outer side, and first and second ends;

b. an elongated wedge member extending along the length of said inner side of said vertically oriented elongated planar member from near said first end thereof to said second end thereof and projecting outwardly away from said inner side of said vertically oriented elongated planar member, said elongated wedge member having a horizontally oriented planar surface aligned with said planar lower surface of said horizontally oriented elongated planar member and a slanted surface extending from said horizontally oriented planar surface to a location on said inner side of said vertically oriented elongated planar member;

c. a vertically oriented plate member joined to said second end of said horizontally oriented elongated planar member, said vertically oriented plate member forming an obtuse angle with said outer side of said vertically oriented elongated planar member and joining said elongated wedge member at said second end of said vertically oriented elongated planar member; and, d. an upwardly angled plate member attached to said horizontally oriented and vertically oriented elongated planar members at said first ends thereof.

12. The street sweeper drag shoe as defined in claim 11, wherein said right-angle member, said elongated wedge member, said vertically oriented plate member, and said upwardly angled plate member are all portions of a single, unitary, one-piece, cast metal body.

13. A drag shoe for a street sweeper, wherein a rotary broom cleaning head rests on a pair of drag shoes and includes a rotary broom therebetween, and where the rotary broom is defined by a rotation axis and a transverse central axis perpendicular to the rotation axis, and where broom bristles extend generally radially from the rotation axis and include splayed bristles at each end of the rotary broom away from the central axis, the drag shoe comprising:

a. a contact skid generally aligned with the central axis of the rotary broom and configured for resting on a roadway surface intended to be swept; and b. a broom bristle compression member coupled to the contact skid and generally aligned transverse to the roadway surface so as to form an outermost broom facing wall generally perpendicular to the broom rotation axis and having a wall outward surface facing toward the central axis of the broom, and capable of making contact with the outermost bristles of the broom extending away from the central axis, the broom bristle compression member having, (1) a forward compression member generally aligned with the central axis of the broom having a forward end and a rearward end, and the contact skid is positioned such that the forward compression member contacts the outermost bristles of the broom, and (2) a rearward compression member, extending rearward from the forward compression member rearward end and tapered away from the central axis forming an acute angle therebetween so as to guide splayed bristles inwardly as the broom rotates.

14. The drag shoe of claim 13, wherein the forward compression member has an upper portion and a lower portion relative to the road surface, and the lower portion extends more inwardly toward the central axis than the upper portion.

* * * * *